United States Patent [19]

Rogers

[11] Patent Number: 4,471,757

[45] Date of Patent: Sep. 18, 1984

[54] LOG SUPPORT FOR FIREPLACE

[76] Inventor: William W. Rogers, 4407 Paran Pl., Atlanta, Ga. 30327

[21] Appl. No.: 475,595

[22] Filed: Mar. 15, 1983

[51] Int. Cl.[3] ..... F23H 1/02

[52] U.S. Cl. ..... 126/152 B; 126/163 A; 126/164; D23/138.2

[58] Field of Search ..... 126/152 R, 152 A, 152 B, 126/163 R, 163 A, 164, 298, 165, 201, 120; 110/300; D23/138.2, 138.3, 138.4; 211/60 R

[56] References Cited

U.S. PATENT DOCUMENTS

| | | | |
|---|---|---|---|
| D. 196,997 | 11/1963 | Falkenberg et al. | D81/18 |
| D. 215,439 | 9/1969 | Hetu | D23/3 |
| 2,185,028 | 12/1939 | Hoiland | 126/163 A |
| 2,985,165 | 5/1961 | Peterson et al. | 126/152 A |

FOREIGN PATENT DOCUMENTS

| | | | |
|---|---|---|---|
| 981548 | 1/1976 | Canada | 126/164 |
| 9202 | of 1897 | United Kingdom | 126/152 R |
| 30109 | of 1897 | United Kingdom | 126/152 R |
| 28029 | of 1913 | United Kingdom | 126/163 A |
| 152180 | 10/1920 | United Kingdom | 126/163 |

*Primary Examiner*—James C. Yeung

*Attorney, Agent, or Firm*—Sutherland, Asbill & Brennan

[57] ABSTRACT

A device for use in fireplaces or wood stoves to facilitate the burning of small fires, e.g., fires having only one or two logs burning at a time, and to provide more radiated heat from the fire, is disclosed. The device is a log support, consisting essentially of a hollow, elongated, rectangular box constructed of iron, the box being open at both ends, having a plurality of openings in its top, a plurality of openings in its bottom, and a plurality of openings in each of its sides, and having means on its top surface for preventing a round log from rolling off the box.

22 Claims, 6 Drawing Figures

FIG. 1
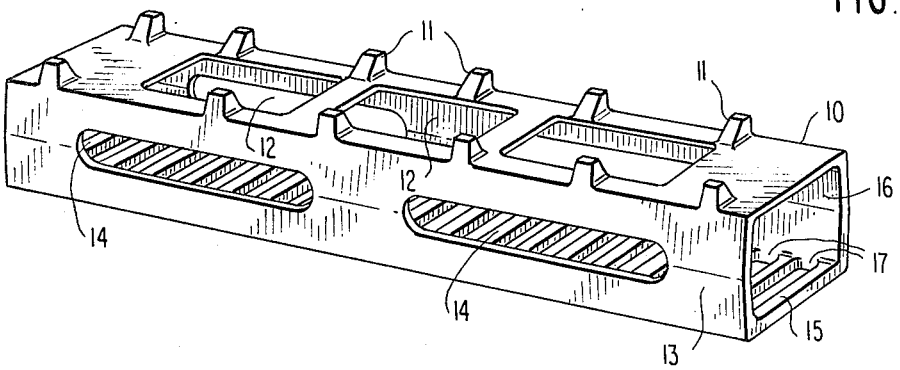
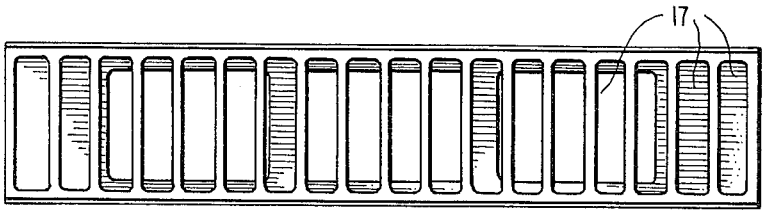
FIG. 2
FIG. 3
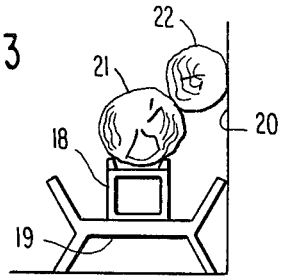
FIG. 4
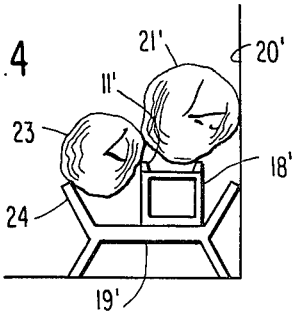
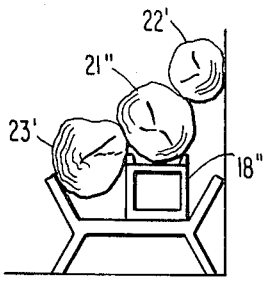
FIG. 5
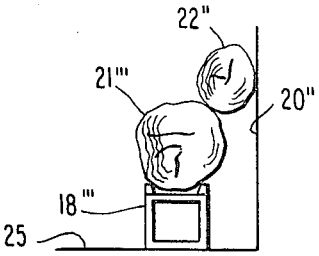
FIG. 6

LOG SUPPORT FOR FIREPLACE

This invention concerns a log support for use in fireplaces or wood stoves—in particular, a support which provides for more efficient and even burning of fireplace wood.

A common impediment to the enjoyment of the warmth and ambiance of a wood-burning fireplace is the difficulty of keeping a small fire burning evenly. When one wants to burn only one or two logs at a time, it is very difficult to do so in a conventional fireplace grate or on andirons. The present invention resides in a device that greatly facilitates such fires, allowing them to burn relatively evenly and to a point where substantially all of the wood has been consumed. Moreover, and perhaps of even greater importance, when using the device I have invented, whether for small fires or large, there appears to be more heat radiated from the fireplace than when burning the same volume of wood on a conventional grate or on andirons. Thus, one can use my device to generate the same amount of radiated heat from less wood.

The device I have invented is a log support for a fireplace, consisting essentially of a hollow, elongated, rectangular box constructed of iron, the box being open at both ends, having a plurality of openings in its top, a plurality of openings in its bottom, and a plurality of openings in each of its sides, and having means on its top surface for preventing a round log from rolling off the box. The support is used by placing it in the fireplace, bottom down and one of its sides facing out, either on the inner hearth, or, preferably, on a grate. The support can also be used supported on andirons, or even in an air-tight wood stove, if the stove is large enough.

In using the fireplace log support of the present invention, one log should always be on top of the support. (By "log" is here meant any long piece of firewood—either a whole, round segment of a tree trunk or limb, or a piece of such a segment that has been split for easier burning). Once that log is fully ignited, it should continue to burn evenly until it is substantially completely consumed. If a second log is to be used to replace the first after it has burned to about one-third, say, of its original volume, the second log can be pre-heated by having it in front of the support as the first log burns. The burning remains of a top log that is being replaced by a fresh log should be pushed off the back edge of the support.

To start a fire using the log support of the present invention, starter material, normally paper or wood, e.g., a combination of crumpled newspapers and pine fatwood, is placed inside the support and ignited. The fire will be easier to start if the support is placed near the rear wall of the fireplace and two logs are used: one directly on top of the support, and another slightly behind and on top of the first log and leaning against the rear wall of the fireplace. Starting material should be placed under the second log as well.

To start and maintain a fire with only one or two logs when using the log support of the present invention, it will normally be necessary to use aged wood that is relatively dry.

While not wishing to be bound by theory, I believe that the reason my device is so successful in maintaining a one-log fire and in radiating so much heat into the room is that its configuration causes a draft to be swept into the side, end, and bottom openings in the box, which flows out the top openings and curls around the log on top of the support, before going up the chimney. In this manner, I believe, a more concentrated flow of air is used than is the case when the same volume of wood is burned on a conventional grate or on andirons, with the result that less warm air escapes up the chimney and more of the heat of combustion radiates into the room. I believe, furthermore, that the burning embers that collect inside the box, both from the starter material and as fragments from the burning log above, aid this process.

The open area in each side of the log support of the present invention is preferably about 15 to 30 percent of the overall area of the side. These side openings preferably consist of two or more longitudinally aligned, lengthwise slots of approximately equal width. Ideally, the configuration of the openings is the same in the front side as in the back side of the box.

The open area in the bottom of the box is preferably about 60 to 75 percent of the overall area of the bottom. The bottom openings preferably consist of a series of parallel, elongated, lateral openings of approximately equal size, positioned at regular intervals substantially throughout the length of the box. In other words, the bottom of the box is preferably constructed like a grate.

As an optional feature, the box may have short feet on it, in order to facilitate an updraft through the bottom openings when the box is used directly on the inner hearth, rather than on a grate. In actual tests, however, the box has functioned well without such feet, both on the inner hearth in a fireplace and when sitting on the floor of a woodburning stove.

The open area in the top of the box is preferably about 30 to 50 percent of the overall area of the top. Preferably the total area of the top openings will exceed that of the openings in either side of the box, and most preferably the area of the top openings will equal or exceed the combined area of the openings in both sides of the box. The top openings preferably consist of a series of longitudinally aligned, rectangular openings of approximately equal size. The preferred means for preventing a log from rolling off the top surface consist essentially of an upwardly projecting ridge along each long edge of the top surface. The ridge can be either an even, unbroken lip, or, more preferably, a row of protuberances, i.e., tooth-like projections, of substantially equal size.

The ratio of the width to the height of the log support of the present invention is preferably within the range of about 0.88 to 1.13, most preferably from about 0.94 to about 1.06. Ideally, the box will range in width from about 3 to about 6 inches and will range in length from about 14 to about 30 inches.

A specific embodiment of the present invention, showing my present contemplation of the best mode of carrying it out, is depicted in the attached drawings, in which:

FIG. 1 is an isometric view of a log support of the present invention, which can be made in one piece out of grey cast iron.

FIG. 2 is a bottom view of the log support depicted in FIG. 1.

FIGS. 3–6 are end views of a log support of the present invention, showing four different arrangements for using it in a fireplace.

Referring in more detail to FIGS. 1 and 2, it is seen that top side 10 of the log support contains three rectangular openings 12 of equal size that account for roughly 35 to 40 percent of the overall area of the top surface. Such a support might measure, for example, about 20 inches long, by 4 inches wide, by 3¼ inches high. In that particular embodiment the total area of the top openings will be roughly 32 square inches. Protruding up from surface 10 are two rows of teeth 11 that serve to prevent a round log (see, for example, FIG. 3) from rolling off the box.

Both ends of the box shown in FIGS. 1 and 2 are open. In the front side 13 of the box are two longitudinally aligned, lengthwise slots 14 of equal width and length. Slots 14 are approximately centered between the top 10 and bottom 15 of the box. The combined area of openings 14 accounts for approximately 20 to 25 percent of the overall area of side 13. The back side 16 of the box is identical to the front side 13. Thus, in a support having the measurements suggested above—i.e., a length of 20 inches, a width of 4 inches, and a height of 3¼ inches—the total area of the openings in one side will be approximately 15 square inches, making the open area in the top (about 32 sq. in.) slightly more than the total open area of the two sides combined (about 30 sq. in.).

In the bottom 15 of the box is a series of parallel, elongated, lateral openings 17 that are positioned at regular intervals substantially throughout the length of the box. The total area of the openings 17 accounts for about 65 to 70 percent of the overall area of bottom 15.

FIG. 3 shows what I believe to be the most dependable arrangement for starting a fire using the log support of the present invention. Log support 18 is placed in the center of grate 19, which is against the rear wall 20 of the fireplace. One log 21 is placed on the top surface of support 18, and a second log 22 is placed on top of log 21, toward the back side thereof, leaning against rear wall 20. Starter material (not shown) is placed inside support 18 and underneath log 22.

After the logs in FIG. 3 burn down to about one-third their original size, their remains are pushed to the back of grate 19, behind support 18, and a single fresh log is placed on top of support 18. From that time on only one log at a time should be needed on top of support 18 to keep the fire going.

FIG. 4 shows alternative way of using support 18'. With support 18' resting near the rear of grate 19', log 23 is laid between the front row of teeth 11' on support 18' and the front lip 24 of grate 19'. Log 21' is placed as nearly on top of support 18' as possible, and starter material (not shown) is again placed inside and behind support 18'. In this manner log 21' will burn, while log 23 will be warmed. When it comes time to replace log 21', that can best be done by pushing the remains of 21' off the rear edge of support 18', placing heated log 23 on top of support 18', and putting a fresh log (not shown) in the space where log 23 was originally. This procedure can be periodically repeated for as long as it is desired to keep the fire going.

FIG. 5 shows still another way of using the support of the present invention, which essentially combines the features of FIGS. 3 and 4. In this arrangement, which can be advantageous when starting a fire with wood that is relatively difficult to ignite, log 23' is primarily only warmed while logs 21'' and 22' are being burned. When logs 21'' and 22' have burned down to roughly one-third their original size, their remains can be pushed to the rear of support 18'', and log 23' can be moved to the top of support 18''. A fresh log can then be laid in front of support 18'', to be used when log 23' needs replacing.

FIG. 6 shows how the log support of the present invention can be used without a fireplace grate. Support 18''' is placed directly on the inner hearth 25 of the fireplace; log 21''' is placed on top of support 18'', and log 22'' is placed in the space between the top of log 21''' and the rear wall 20'' of the fireplace. The fire is started and maintained in the same manner as described for FIG. 3.

The foregoing are just some of the different arrangements in which the log support of the present invention can be used effectively. Other suitable arrangements will be apparent to the user or will be discovered by trial and error.

I claim:

1. A log support for a fireplace, consisting essentially of a hollow, elongated, rectangular box constructed of iron, said box being open at both ends, having a plurality of openings in its top, a plurality of openings in its bottom and a plurality of openings in each of its sides, and having an upwardly projecting ridge along each long edge of its top surface for preventing a round log from rolling off the box, the open area in each side of the box constituting about 15 to 30 percent of the overall area of said side, the open area in the top of the box constituting about 30 to 50 percent of the overall area of the top, the open area in the bottom of the box constituting about 60 to 75 percent of the overall area of the bottom, and the open area in the top of the box exceeding the open area in each side of the box.

2. The log support of claim 1 wherein the openings in the bottom of the box consist of a series of parallel, elongated, lateral openings of approximately equal size, positioned at regular intervals substantially throughout the length of the box.

3. The log support of claim 2 wherein the openings in the top of the box consist of a series of longitudinally aligned, rectangular openings of approximately equal size.

4. The log support of claim 3 wherein the openings in each side of the box consist of two or more longitudinally aligned lengthwise slots of approximately equal width, and the open area in the top of the box equals or exceeds the combined area of the openings in both sides of the box.

5. The log support of claim 4 wherein the ratio of the width of the box to the height of the box is within the range of about 0.88 to 1.13.

6. The log support of claim 5 wherein the upwardly projecting ridge along each long edge of the top surface is a row of tooth-like projections.

7. The log support of claim 6 wherein the width of the box is within the range of about 3 to 6 inches, the length of the box is within the range of about 14 to 30 inches, and the ratio of the width to the height is within the range of about 0.88 to 1.13.

8. The log support of claim 5 wherein the width of the box is within the range of about 3 to 6 inches, the length of the box is within the range of about 14 to 30 inches, and the ratio of the width to the height is within the range of about 0.88 to 1.13.

9. The log support of claim 4 wherein the width of the box is within the range of about 3 to 6 inches, the length of the box is within the range of about 14 to 30 inches, and the ratio of the width to the height is within the range of about 0.88 to 1.13.

10. The log support of claim 3 wherein the width of the box is within the range of about 3 to 6 inches, the length of the box is within the range of about 14 to 30 inches, and the ratio of the width to the height is within the range of about 0.88 to 1.13.

11. The log support of claim 2 wherein the openings in each side of the box consist of two or more longitudinally aligned lengthwise slots of approximately equal width.

12. The log support of claim 2 wherein the ratio of the width of the box to the height of the box is within the range of about 0.88 to 1.13.

13. The log support of claim 2 wherein the upwardly projecting ridge along each long edge of the top surface is a row of tooth-like projections.

14. The log support of claim 1 wherein the openings in the top of the box consist of a series of longitudinally aligned, rectangular openings of approximately equal size.

15. The log support of claim 14 wherein the openings in each side of the box consist of two or more longitudinally aligned lengthwise slots of approximately equal width.

16. The log support of claim 1 wherein the openings in each side of the box consist of two or more longitudinally aligned, lengthwise slots of approximately equal width.

17. The log support of claim 16 wherein the ratio of the width of the box to the height of the box is within the range of about 0.88 to 1.13.

18. The log support of claim 16 wherein the upwardly projecting ridge along each long edge of the top surface is a row of tooth-like projections.

19. The log support of claim 1 wherein the ratio of the width of the box to the height of the box is within the range of about 0.88 to 1.13.

20. The log support of claim 19 wherein the upwardly projecting ridge along each long edge of the top surface is a row of tooth-like projections.

21. The log support of claim 1 wherein the upwardly projecting ridge along each long edge of the top surface is a row of tooth-like projections.

22. The log support of claim 1 wherein the width of the box is within the range of about 3 to 6 inches, the length of the box is within the range of about 14 to 30 inches, and the ratio of the width to the height is, within the range of about 0.88 to 1.13.

* * * * *